US005306512A

United States Patent [19]

Blamer

[11] Patent Number: 5,306,512

[45] Date of Patent: Apr. 26, 1994

[54] METHOD AND MEANS FOR ENHANCING MICROWAVE POPPING OF POPCORN

[75] Inventor: Robert H. Blamer, Westmont, Ill.

[73] Assignee: Bagcraft Corporation of America, Chicago, Ill.

[21] Appl. No.: 384,077

[22] Filed: Jul. 24, 1988

Related U.S. Application Data

[63] Continuation of Ser. No. 16,522, Feb. 17, 1987, abandoned, and a continuation of Ser. No. 732,139, May 9, 1985, abandoned.

[51] Int. Cl.[5] ..... B65B 25/22; B65D 81/34

[52] U.S. Cl. ..... 426/107; 426/111; 426/113; 426/234; 426/394; 219/728; 156/277; 156/226; 493/328

[58] Field of Search ..... 426/107, 111, 234, 113, 426/243, 410, 241, 394; 219/10.55 E, 10.55 M, 10.55 F; 156/277, 226

[56] References Cited

U.S. PATENT DOCUMENTS

| | | | |
|---|---|---|---|
| 3,941,967 | 3/1976 | Sumi et al. | 426/234 |
| 3,949,184 | 4/1976 | Freedman | 426/234 |
| 3,973,045 | 8/1976 | Brandberg et al. | 426/234 |
| 4,156,806 | 5/1979 | Teich et al. | 426/243 |
| 4,184,061 | 1/1980 | Suzuki et al. | 426/243 |
| 4,190,757 | 2/1980 | Turpin et al. | 426/243 |
| 4,210,674 | 7/1980 | Mitchell | 426/107 |
| 4,219,573 | 8/9180 | Borek | 426/234 |
| 4,230,924 | 10/1980 | Brastad et al. | 426/234 |
| 4,266,108 | 5/1981 | Anderson et al. | 426/243 |
| 4,267,420 | 5/1981 | Brastad | 426/107 |
| 4,292,332 | 9/1981 | McHam | 426/234 |
| 4,390,554 | 6/1983 | Levinson | 426/234 |
| 4,398,077 | 8/1983 | Freedman et al. | 426/243 |
| 4,450,180 | 5/1984 | Watkins | 426/234 |
| 4,450,334 | 5/1984 | Bowen et al. | 426/243 |
| 4,454,403 | 6/1984 | Teich et al. | 426/243 |
| 4,486,640 | 12/1984 | Bowen et al. | 426/243 |
| 4,495,392 | 1/1985 | Derby | 426/243 |
| 4,553,010 | 11/1985 | Bohrer | 426/243 |
| 4,640,838 | 2/1987 | Isakson et al. | 426/107 |
| 4,641,005 | 2/1987 | Seiferth | 426/107 |
| 4,656,325 | 4/1987 | Keefer | 426/243 |

*Primary Examiner*—Steven Weinstein
*Attorney, Agent, or Firm*—Hill, Steadman & Simpson

[57] ABSTRACT

In a popcorn package for microwave popping, the subsequent popping of popcorn by microwave energy is enhanced by the use of a layer of metallized ink printed on the bag of a popcorn package. The metallized ink contains powdered aluminum and is of a commercial grade but diluted to provide an opacity level of light transmission in the range of 47% to 10%, such layer lying below the charge of popcorn and shortening during popping. The material of the bag comprises a pair of plies with the layer of metallized ink being printed to one of the plies and disposed between the plies of the bag.

14 Claims, 1 Drawing Sheet

METHOD AND MEANS FOR ENHANCING MICROWAVE POPPING OF POPCORN

This is a continuation of application Ser. No. 02/016,522 filed Feb. 17, 1987 (now abandoned) which was a continuation of Ser. No. 05/732,139, May 9, 1985 (now abandoned).

BACKGROUND OF THE INVENTION

1. Field of the Invention

The present invention relates to popping of popcorn using microwave energy.

2. Prior Art

A popcorn package for microwave popping is shown in U.S. Pat. No. 3,973,045, issued on Aug. 3, 1976. With minor differences, this publication reflects a type of popcorn package that the assignee of such patent has been marketing in the USA for the last several years. Normally, the popcorn package is kept frozen until ready to use. Also, it is normal for many unpopped kernels to remain in a correctly popped package.

SUMMARY OF THE INVENTION

It is therefore an object of the present invention to enhance the popping of a popcorn package provided for microwave popping.

According to the present invention, a layer of metallized ink is printed on the bag of a popcorn package, and in doing so, enhances the subsequent popping of popcorn in the package by microwave energy.

Many other advantages and features of the present invention will become manifest to those versed in the art upon making reference to the detailed description and the accompanying sheet of drawings in which a preferred structural embodiment incorporating the princples of the present invention is shown by way illustrative example.

DETAILED DESCRIPTION

Figure 1:
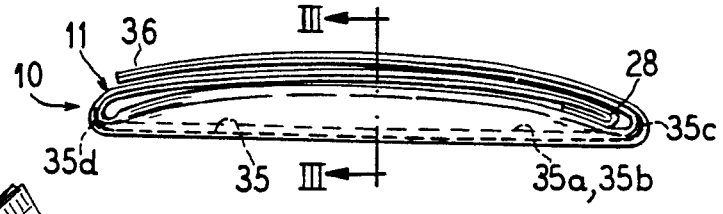
FIG. 1 is a front-end elevational view of a popcorn package provided in accordance with the principles of the present invention.
Figure 2:
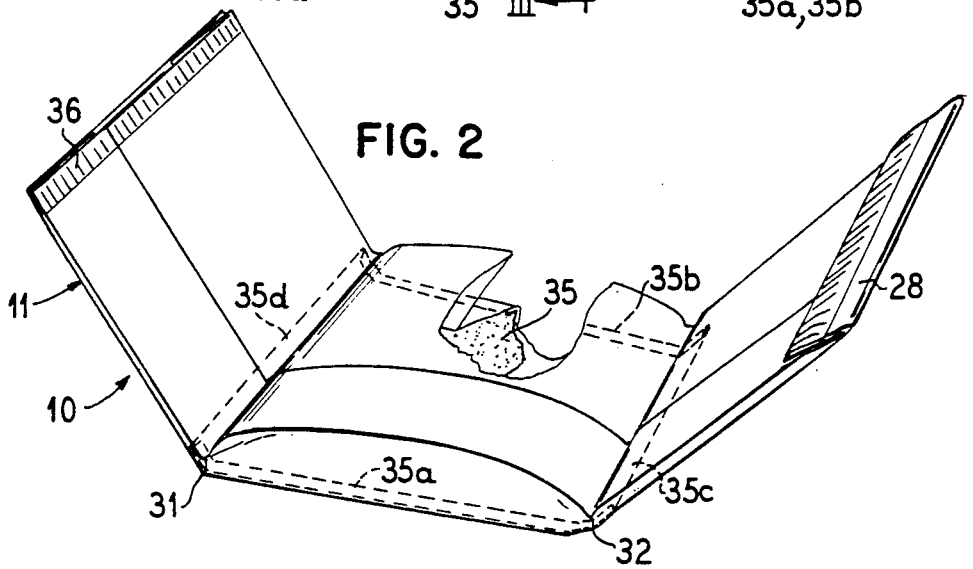
FIG. 2 shows in perspective, the package of FIG. 1, partially opened for popping and partially broken away for illustration.
Figure 3:
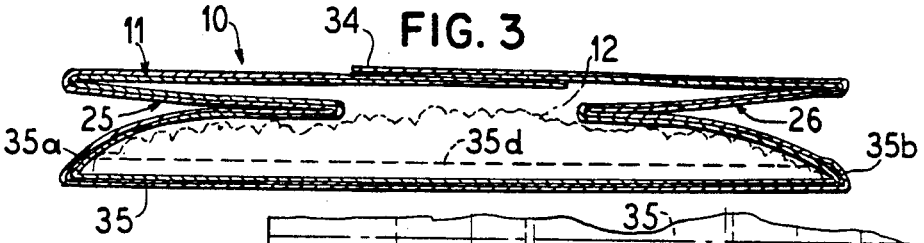
FIG. 3 is an enlarged vertical cross-section taken generally along line III—III of FIG. 1.

The principles of the present invention are particularly useful when embodied in a popcorn package as shown in FIGS. 1-3, generally indicated by the numeral 10. The package 10 includes a bag 11 which is sealed closed in an air-tight manner, there being a charge 12 of popcorn, shortening, and optionally salt, enclosed therein.

Figure 4:
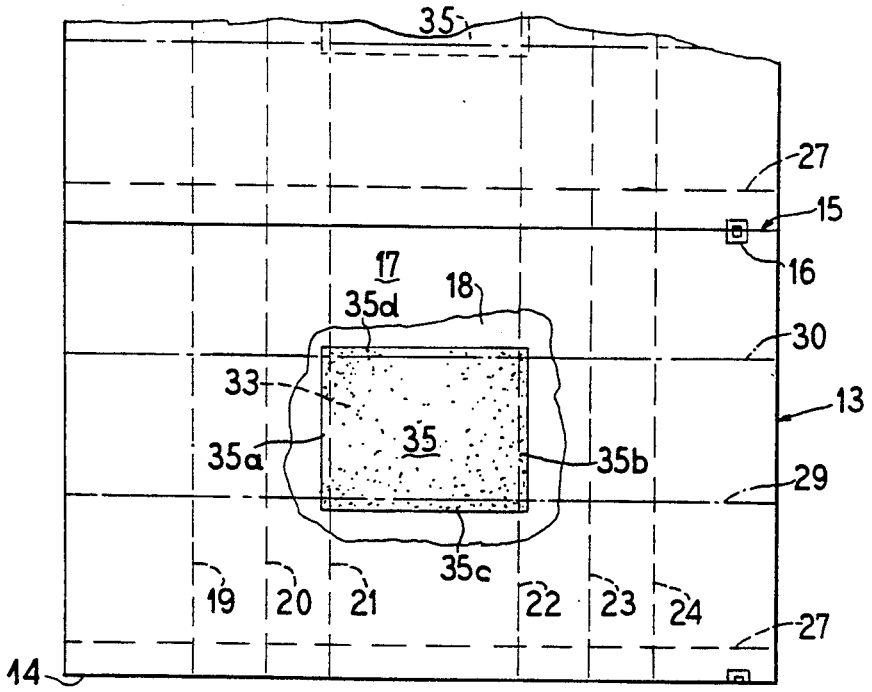
FIG. 4 is a plan view of a web, partially broken away, from which the bag of FIGS. 1-3 is made.

The bag 11 is manufactured from a web 13 as shown in FIG. 4, there being a severed edge 14 and a prospective severance edge 15 identified by a registration indicator 16 included thereon for being sensed by automatic machinery to provide a cut at the prospective severance line 15, thus, placing all printing (some of which is not shown) on the bag in registration with the severance lines 14.

The web 13 is made up of two plies 17, 18, both of which may be paper, one ply being receptive of printing and the other ply being grease-proof. Alternatively, a grease-proof ply may comprise a polyester such as "Mylar" (trademark).

The web 13 has six prospective longitudinal fold lines 19-24 for forming a pair of gussets 25, 26, (FIG. 3). The web 13 has a transverse prospective fold line 27 about which the end of the bag 11 is folded to provide one sealed end 28 (FIG. 2). Further, the web 13 has a pair of transverse fold lines 29, 30 to provide transverse folds 31, 32 (FIG. 2) about which the sealed end portions of the bag are folded.

The prospective side gusset folding lines 21, 22 represent the outer longitudinal edges of the bag 11, and jointly with the prospective folding lines 29, 30 define an area 33. When the web 13 is folded about the prospective longitudinal folding lines 19-24, the marginal portions of the web overlap one another and are sealed to one another to provide a backseam 34 (FIG. 3). Thus, the area 33 lies at the front side of the bag while the backseam 34 lies at the back of the web.

According to the present invention, during the fabrication of the web 13, there is a layer of metallized ink 35 applied by printing to one of the unexposed sides of one of the web plies 17, 18 so that it is separated by one ply from the atmosphere and by one ply from the contents or charge 12.

The metallized ink layer 35 is made from a commercially available metallic ink having aluminum powder. One example of such ink is Aquaflex Silver No. 4011316 as provided by Sinclair and Balantine, 4100 S. Pulaski, Chicago, Ill. 60632. This ink is modified before printing, by dilution. The diluent may consist entirely of water, and may be a mixture of water and isopropyl alcohol, such diluent mixture being no less than 50% water. The original strength of ink is diluted to contain 15-25% diluent, and thus the ink is diluted to 85-75% of its original strength. The layer of metallized ink 35 is applied to the area 33 so as to overlap its limits. The layer of metallized ink is of such quantity as to have an opacity level of light transmission in the range of 47% to 10% such as measured with a Tobias Densitoneter, model T.C.X.

After the web 13 has been fabricated and printed, the web is folded about its longitudinal prospective fold lines 19-24, the backseam 34 is sealed, and one end 28 is closed and sealed. At this point, marginal portions **35*a* and 35*b* of the layer 35 project into the gussets 25, 26, and the bag 11** is now ready to be sold by its manufacturer to a customer whose own indicia such as trademarks and popping instructions have been applied.

The customer now completes the package 10 by inserting the charge 12, sealing the opposite end 36, and applying two folds 31, 32 to complete the package 10 shown in FIG. 1. In that the fold lines 31, 32 made from prospective fold lines 29, 30 extend through the area 35, additional marginal portions **35*c*, 35*d* extend beyond such folds or fold lines. When the package of FIG. 1 is unfolded to the position of FIG. 2, the marginal portions 35*a-d* of the layer 35 extend upwardly from the area 33 at the edges thereof to form a pan-like configuration between the plies 17, 18 so that every portion of the charge 12 is underlaid and encircled by the layer 35** of metallized ink.

The popping instructions and procedures are the same as those now in commercial use. However, the popping results typically in a 40% reduction in unpopped kernels, thereby increasing the yield, and in addition, the kernels on popping experience a greater amount of expansion. Therefore, a higher percentage of the kernels are popped and each pops to a larger size. Thus the use of a layer of metallized ink printed on a bag of a popcorn package enhances the subsequent popping of the popcorn by microwave energy, such enhancement being in the form of both less unpopped kernels and in the form of a larger expansion of a kernel during popping.

Although various minor modifications may be suggested by those versed in the art, it should be understood that I wish to embody within the scope of the patent warranted hereon, all such embodiments as reasonably and properly come within the scope of my contribution to the art.

I claim as my invention:

1. A sealable bag for receiving a charge of popcorn and shortening for microwave popping, comprising:

a two-ply bag having side gussets and one sealed end adapted to be folded along spaced lines extending transversely to said gussets to define an area on which the corn and shortening is to be placed, said area being in registration with a printed layer of metallized ink on an unexposed surface of one of the plies of said bag.

2. A bag according to claim 1, said layer of ink extending beyond said area.

3. A bag according to claim 1, said layer of ink extending beyond said lines and also into said gussets.

4. A bag according to claim 1, said metallized ink being a commercial grade diluted to 75% to 85% of its original strength.

5. A bag according to claim 4 in which the diluent is at least 50% water.

6. A bag according to claim 5 in which the diluent includes isopropyl alcohol.

7. A bag according to claim 1, said bag originally comprising a web with longitudinal marginal portions overlapped and sealed to form a back seam, said layer of metallized ink being disposed at a side of the bag opposite to said backseam.

8. A bag according to claim 1, said bag having an outer ply of paper and inner ply of paper.

9. A bag according to claim 1, said bag having an outer ply of paper and an inner ply of polyester.

10. A bag according to claim 1, said layer of ink being of such quantity as to have an opacity level of light transmission in the range of 47% to 10%.

11. A bag according to claim 1, said printed layer of ink being non-continuous and in registry with other printed indicia on the bag.

12. A popcorn package for microwave popping, comprising:

(a) a two-ply bag having side gussets and sealed ends, said bag being folded along spaced lines extending transversely to said gussets, and defining a central area at one side of said bag;

(b) a charge of popcorn and shortening disposed in said bag on said area; and (c) a layer of printed metallized ink on one of the unexposed plies of said bag and disposed in registration with said area.

13. A popcorn package according to claim 12, said layer having marginal portions extending upwardly into said gussets and toward said sealed ends to define a shallow pan-like configuration responsive to microwave energy.

14. A method for making a popcorn package for microwave popping comprising the steps of:

printing a layer of metallized ink on a selected region on one side of a ply adapted to be formed into a bag;

combining the ply with the metallized ink printed thereon with an identical ply with the metallized ink layer facing the identical ply so as to be unexposed to the interior and to the exterior of a completed bag;

forming the two plies into a two-ply bag having side gussets and sealed ends; and folding said two-ply bag along spaced lines extending transversely to said gussets to define a central area at one side of said bag adapted to receive a charge of popcorn and shortening inside said bag, said central area being at least partially in registry with the unexposed layer of printed metallized ink.

* * * * *